US006182762B1

(12) United States Patent
Harris

(10) Patent No.: US 6,182,762 B1
(45) Date of Patent: Feb. 6, 2001

(54) STORM VALVE

(76) Inventor: Monty E. Harris, 501 Twilla, Azle, TX (US) 76020

( * ) Notice: Under 35 U.S.C. 154(b), the term of this patent shall be extended for 0 days.

(21) Appl. No.: 09/160,374

(22) Filed: Sep. 24, 1998

Related U.S. Application Data

(60) Provisional application No. 60/059,809, filed on Sep. 24, 1997.

(51) Int. Cl.[7] ..... E21B 7/128; E21B 33/129; E21B 34/12

(52) U.S. Cl. ..... 166/339; 166/340; 166/348; 166/356; 166/358; 166/363; 166/364; 166/365; 166/373; 166/330; 166/332.2; 166/332.4; 166/334.4; 166/382; 166/387

(58) Field of Search ..... 166/339, 340, 166/344, 348, 356, 358, 363–365, 373, 330, 332.2, 332.4, 334.4, 382, 387

(56) References Cited

U.S. PATENT DOCUMENTS 4,372,391 * 2/1983 Barrington et al. ..... 166/373
4,372,392 * 2/1983 Barrington et al. ..... 166/373

* cited by examiner

*Primary Examiner*—Roger Schoeppel
(74) *Attorney, Agent, or Firm*—Felsman, Bradley, Vaden, Gunter & Dillon, L.L.P.; James E. Bradley

(57) ABSTRACT

A method and apparatus for temporarily storing the lower portion of a string of drill pipe in a well which has a cased portion wherein a packer, installed between a storm valve located below the packer and an actuator located above the packer, is set in the annulus between the drill pipe and the well casing, the actuator being designed to close the valve upon initial axial movement of the upper portion of the drill pipe, and then to become disengaged from the lower portion of the set drill pipe allowing the remaining surface suspended drill pipe and actuator to be retrieved as in the case of a floating drill ship or set aside for reconnection and reopening of the storm valve after a storm has passed.

19 Claims, 4 Drawing Sheets

STORM VALVE

CROSS REFERENCE TO RELATED APPLICATIONS

This application claims the benefit of U.S. Provisional Application No. 60/059,809 filed Sep. 24, 1997.

TECHNICAL FIELD

This invention is related in general to offshore well drilling, and in particular to a storm valve that closes a passage of a string of drill pipe, allowing the drill pipe to be stored within a cased portion of a well during a storm.

BACKGROUND ART

In offshore drilling, if a severe storm alert occurs, it may be necessary to evacuate the platform. If a well is being drilled, it is preferable to store the string of drill pipe within the cased portion of the hole, rather than pulling the string to the surface and leaving it on the drilling rig. In doing so, the drill string must be pulled up sufficiently high so that it is fully contained within the cased portion of the well. A packer will be set in the annulus surrounding the drill pipe. A valve in the drill string closes the passage. The packer has a hanger mechanism that supports the weight of the drill string in the well. The portion of the drill string above the valve is retrieved.

While this technique is workable, the valve must be open while the drill string is run into the well, then closed. Closing the valve in the drill string can be a problem, particularly with floating drilling vessels.

A BRIEF DESCRIPTION OF DRAWINGS

Figure 1:
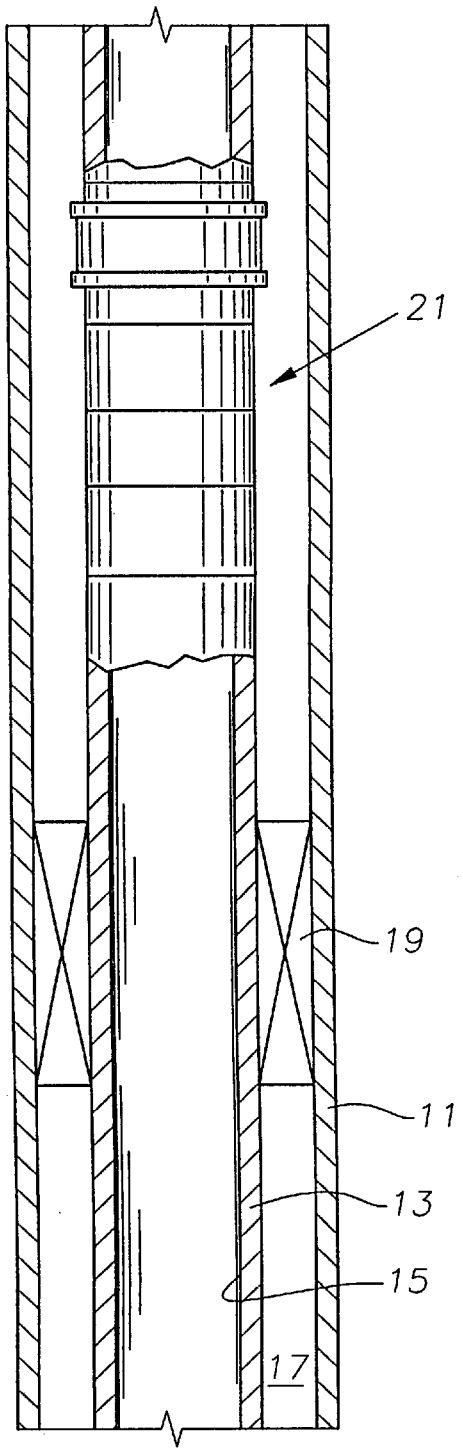

FIG. 1 is schematic view illustrating a storm valve installed within a drill string in accordance with this invention.

FIGS. 2A–2D comprise a vertical sectional view of the storm valve of FIG. 1, shown in the open position.

FIGS. 3A–3D are a sectional view of the storm valve of FIGS. 2A–2D, but showing the valve in a closed position.

DESCRIPTION OF THE BEST MODE

Referring to FIG. 1, casing 11 will be installed within a well. A string of drill pipe 13 is shown located within casing 11. Drill pipe 13 has an axial passage 15. An annulus 17 is located between the exterior of drill pipe 13 and casing 11. A conventional packer 19 is shown set between drill pipe 13 and casing 11, closing annulus 17. A storm valve 21 is shown installed in the string of drill pipe 13 above packer 19. Storm valve 21 is moveable between an open position, shown in FIGS. 2A–2D, and a closed position, shown in FIGS. 3A–3D. In the closed position, storm valve 21 blocks any flow up drill pipe passage 15. Once in the closed position, the upper portion of drill pipe 13 may be released from valve 21 and retrieved while leaving the portion of drill pipe 13 below valve 21 supported within casing 11.

Figure 2A:
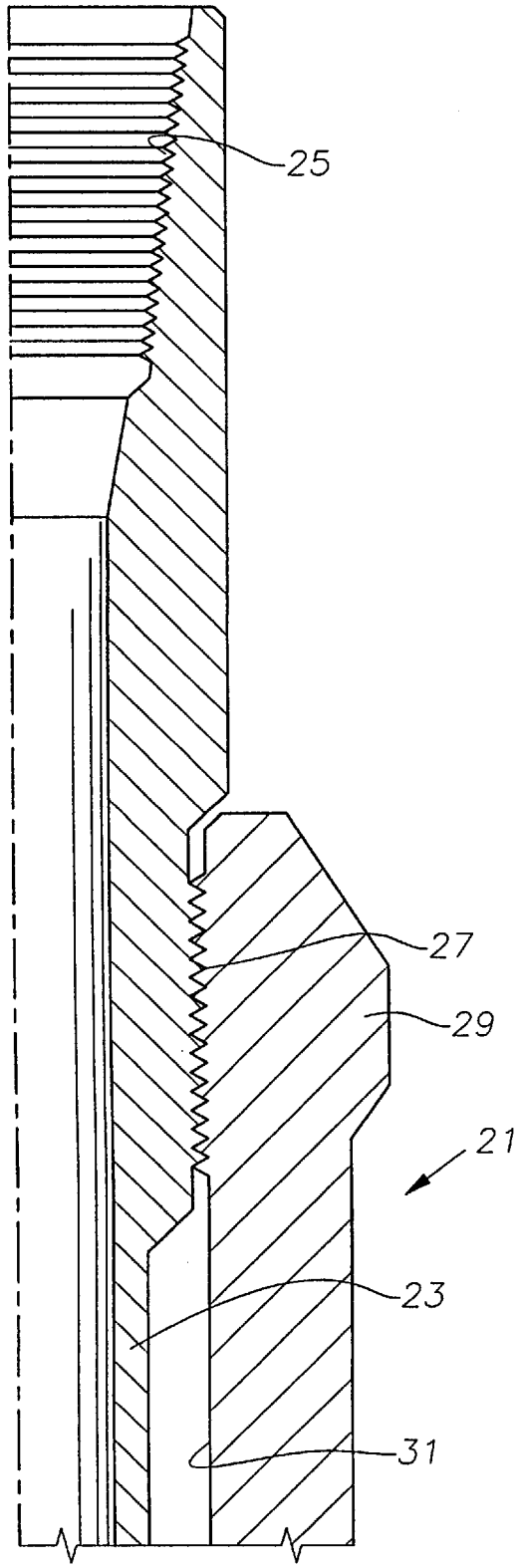

Referring to FIG. 2A, storm valve 21 includes a mandrel upper portion 23, which has a tool joint on its upper end having internal threads 25 for connection into the portion of drill pipe 13 (FIG. 1) extending upward. Mandrel portion 23 also has external threads 27 on its lower end that are secured to a protective collar 29. In the embodiment shown, protective collar 29 extends downward and is of a larger outer diameter than drill pipe 13. Protective collar 29 has an inner diameter 31 that is larger than an outer diameter of mandrel upper portion 23 at that point, defining a clearance. A flared portion 33 is located at the lower end of inner diameter 31, enlarging the clearance, optionally, collar 29 may be an integral part of mandrel upper portion 23, without having a clearance between an outer diameter of mandrel portion 23 and collar 29.

A collet member 35 is secured to mandrel upper portion 23. Collet member 35 has a head 37 that is secured by a retainer pin 39 to mandrel upper portion 23. Retainer pin 39 extends into a slot 41 that is elongated axially to allow limited upward and downward movement of mandrel upper portion 23 relative to collet member 35. In the position shown in FIG. 2B, retainer pin 39 will not allow any upward movement of mandrel upper portion 23 relative to collet member 35, but will allow downward movement.

A lock member 43 is located in head 37 above retainer pin 39. Lock member 43 moves radially inward and outward and is biased inward by a spring 45. In the position shown in FIG. 2B, lock member 43 is held in an outer position due to engagement with a land 46 located between slot 41 and lock recess 47. When mandrel upper portion 23 moves downward relative to collet member 35, lock member 43 will snap into lock recess 47 as shown in FIG. 3B. In this position, collet member 35 and mandrel upper portion 23 are no longer axially moveable relative to each other.

Collet member 35 has a plurality of inward biased depending fingers 49. Fingers 49 are separated from each other by vertical slots (not shown). Fingers 49 have a set of external threads 51 that engage threads 53 located in the interior of an upper housing portion 55. While in engagement with threads 53, fingers 49 lock collet member 35 to upper housing portion 55. Fingers 49 are moveable to a disengaged position out of engagement with threads 53 as shown in FIG. 3B. A plurality of torque members 50 are formed integrally on mandrel upper portion 23. Slots (not shown) are located between torque members 50 for slidably receiving portions of fingers 49. Rotating drill pipe 13 and thus mandrel upper portion 23 will cause fingers 49 to rotate to unscrew from threads 53. Preferably torque members 50 are utilized only in the event of an emergency.

Figure 2B:
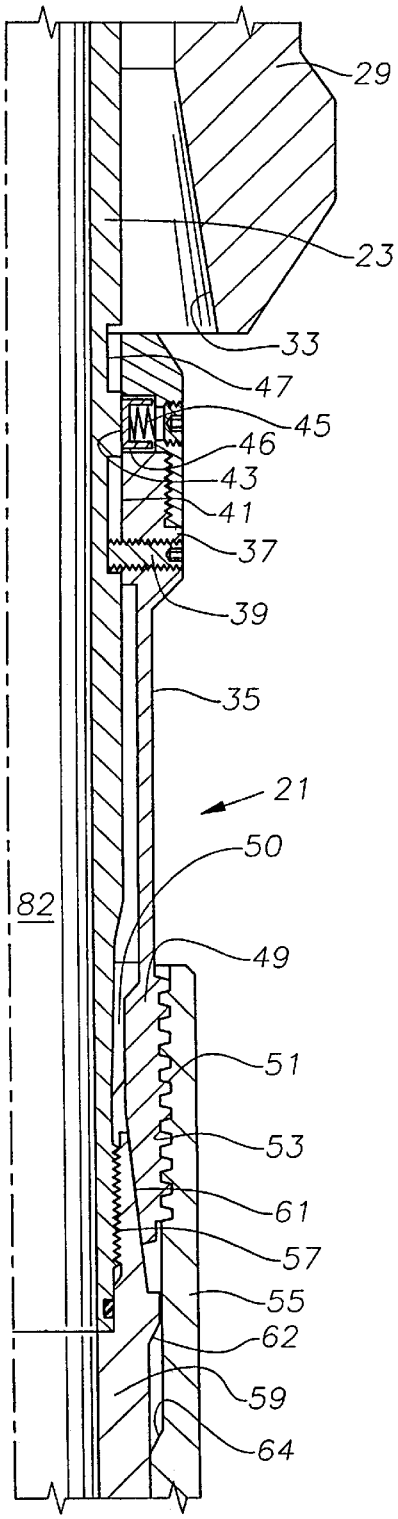
Figure 3A:
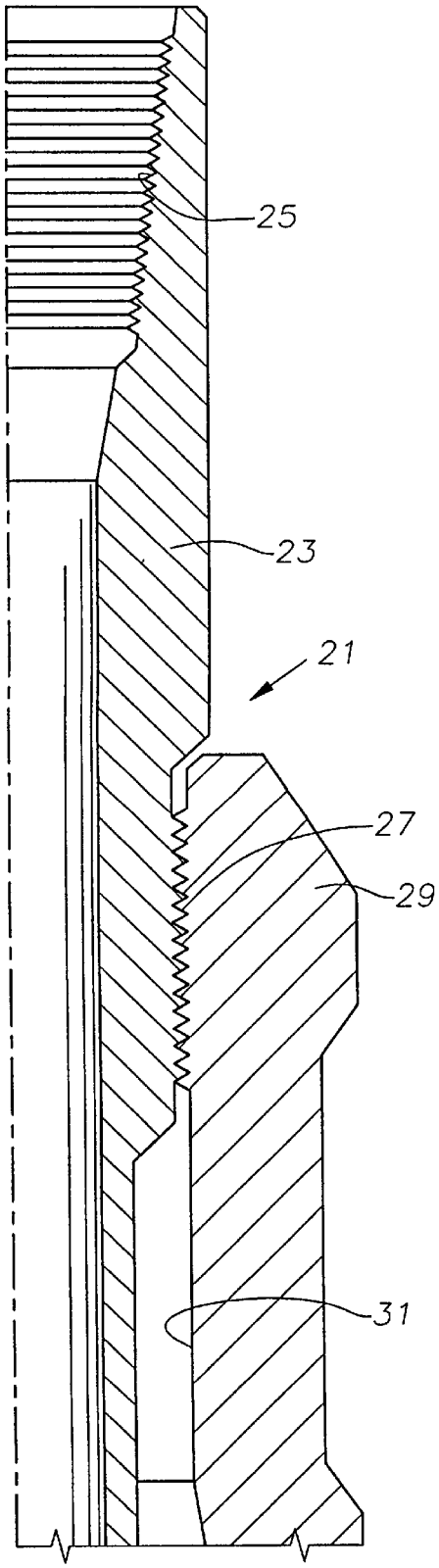
Figure 3B:
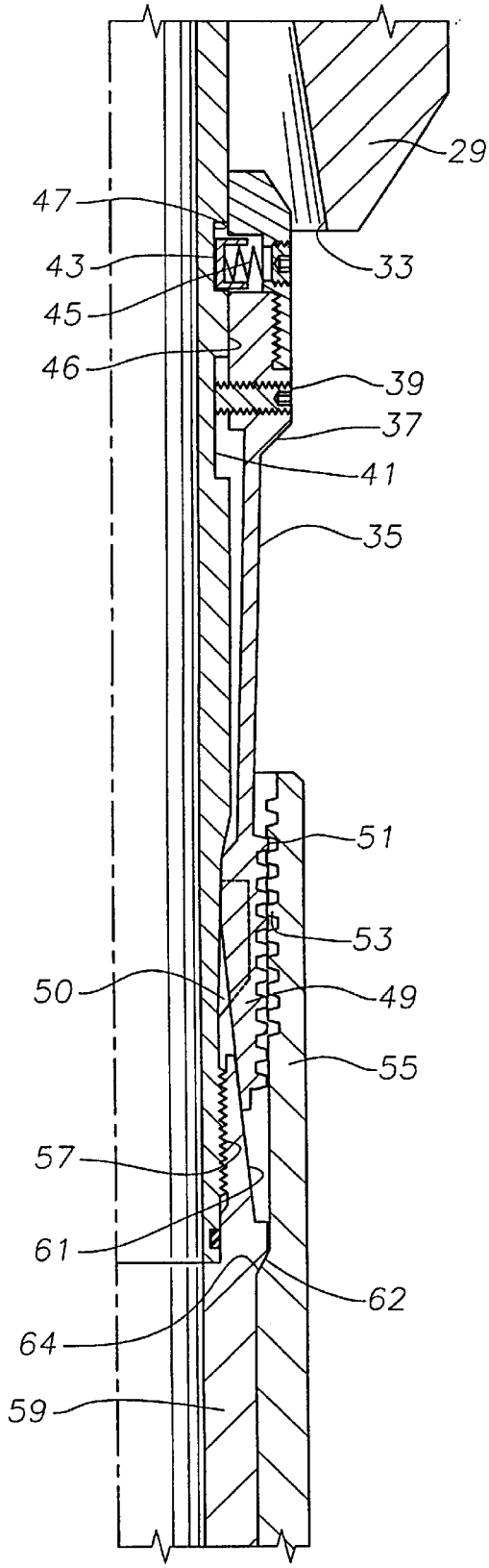

Mandrel upper portion 23 has a set of external threads 57 on its lower end, shown in FIG. 2B, which secure it to a mandrel intermediate portion 59. Mandrel intermediate portion 59 has an external conical cam surface 61 on its upper end. Cam surface 61 engages a mating cam surface in the interior of collet fingers 49. In the position shown in FIG. 2B, cam surface 61 prevents fingers 49 from disengaging threads 53. In FIG. 3B, the lower position of mandrel intermediate portion 59 places cam surface 61 farther from the mating cam surface on fingers 49, allowing fingers 49 to spring away from threads 53, detaching collet 35 from upper housing portion 55. Mandrel intermediate portion 59 has a shoulder 62 which lands on a mating shoulder 64 in the bore of upper housing portion 55.

Figure 2C:
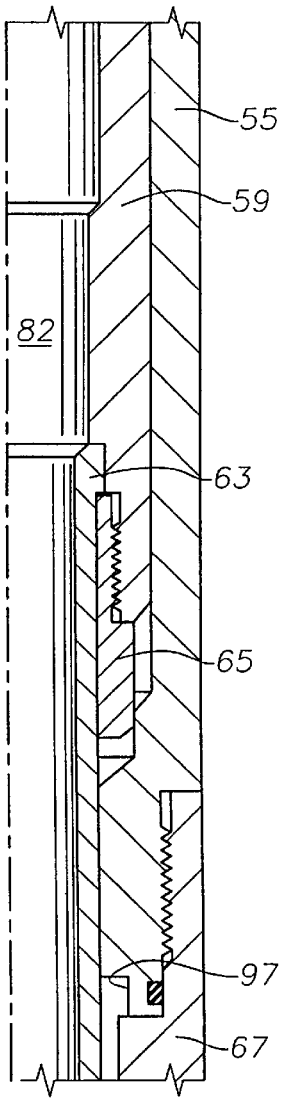
Figure 2D:
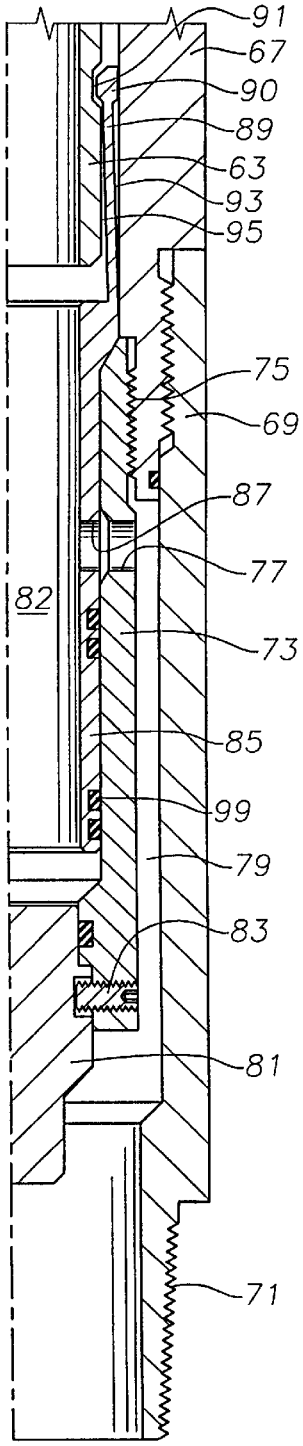

Referring to FIG. 2C, a mandrel lower portion 63 is secured to mandrel intermediate portion 59 by a retainer ring 65. Mandrel lower portion 63 along with mandrel upper portion 23 and mandrel intermediate portion 59 (FIG. 2B) make up a mandrel that operates as a unitary member or actuator assembly. Also shown in FIGS. 2C and 2D, an intermediate housing portion 67 is secured by threads to upper housing portion 55. A lower housing portion 69, shown in FIG. 2D, is secured by threads to intermediate housing portion 67. Housing portions 55, 67 and 69 make up a housing that operates in a unitary manner. A tool joint pin 71 is formed on the lower end of lower housing portion 69. Tool joint pin 71 has external threads for connecting into drill string 13.

An outer valve sleeve 73 is carried within lower housing portion 69. Outer sleeve portion 73 has external threads 75 that engage internal threads on the lower end of lower housing portion 67. Outer valve sleeve 73 has a flow port 77 in its side wall which communicates with an annulus 79 or flowby passage. Annulus 79 is located between the outer diameter of outer valve sleeve 73 and an inner diameter of intermediate housing portion 69. Annulus 79 also communicates with drill pipe internal passage 15 (FIG. 1). A plug 81 is secured to the bottom of outer valve sleeve 73 by threaded retainer pin 83. Plug 81 blocks an interior passage 82 that extends continuously through outer valve sleeve 73, mandrel lower portion 63, mandrel intermediate portion 59, mandrel upper portion 23 and into drill pipe passage 15 (FIG. 1) above storm valve 21. An inner valve sleeve 85 is slidingly carried within outer valve sleeve 73. Inner valve sleeve 85 has a flow port 87 through its side wall that will register with flow port 77 while inner valve sleeve 85 is in the open position as shown in FIG. 2D. While in the open position, drill pipe passage 15 below storm valve 21 communicates with passage 15 above storm valve 21 (FIG. 1) by way of annulus 79 (FIG. 2D), flow ports 87, 77 and valve flow passage 82.

Figure 3C:
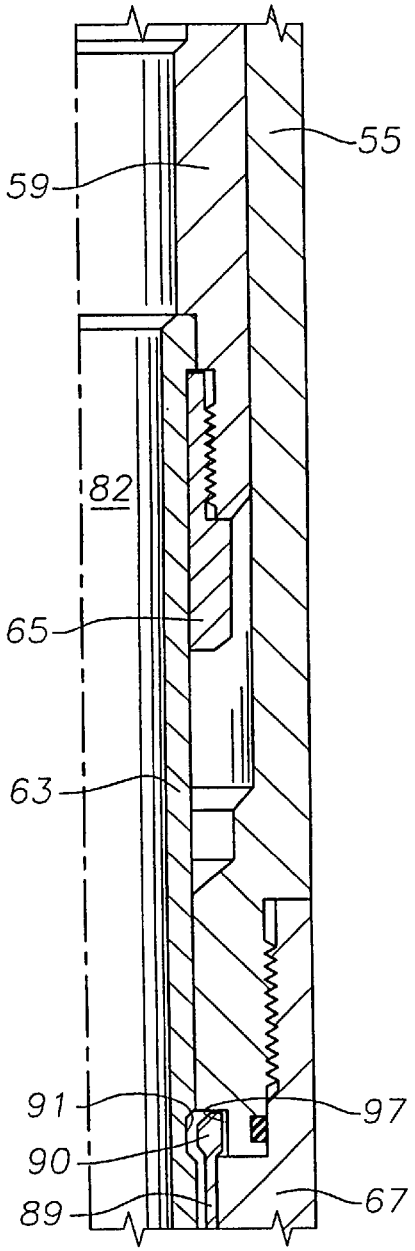
Figure 3D:
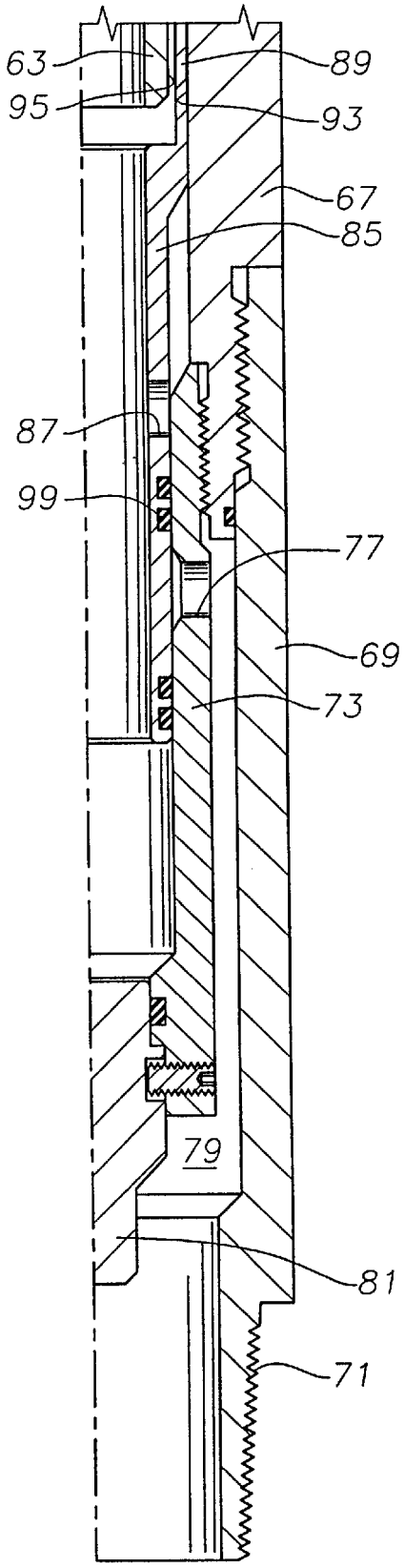

Inner valve sleeve 85 has a valve connector on its upper end made up of a set of collet fingers 89 extending upward from it. Collet fingers 89 are biased outwardly and have enlarged heads at the upper ends. The enlarged heads of fingers 89 locate within an annular groove 91 formed in the outer diameter of mandrel lower portion 63. The radial thickness of each head 90 is greater than the radial clearance between outer diameter 95 of mandrel lower portion 63 and inner diameter 93 of intermediate housing portion 67. This traps heads 90 within groove 91, preventing inner valve sleeve 85 from moving downward with outer valve sleeve 85 the inner valve sleeve moves upward to the position shown in FIG. 3D. As shown in FIG. 2C, a retainer, such as recess 97 is located at the junction between intermediate housing portion 67 and upper housing portion 55. Recess 97 has a greater inner diameter than inner diameter 93, allowing heads 90 of fingers 89 to spring farther outward as shown in FIGS. 3C and 3D. In the outer position, the inner diameters of heads 90 will be spaced slightly outward from outer diameter 95 of mandrel lower portion 63. This allows mandrel lower portion 63 to move upwardly relative to inner valve sleeve 85 as fingers 89 will be disengaged.

Inner valve sleeve 85 has a set of seals 99 located below flow port 87. Seals 99 will seal around flow port 77 to block flow from flow port 77 while in the closed position as shown in FIG. 3D.

In operation, if it is necessary to store drill pipe 13 in casing 11 due to an approaching storm, the operator will pull drill pipe 13 up to a point that leaves a length of drill pipe in the well which is less than the length of casing 11. The operator installs into drill string 13 a conventional packer 19 of a type that sets by rotating. The operator installs storm valve 21 above packer 19. Storm valve 21 will be in an open position as shown in FIGS. 2A–2D. The operator lowers the assembly in the well on drill pipe 13 until storm valve 21 is located at a selected depth within casing 11. The operator then sets packer 19 by rotation. Once packer 19 is set, it will support the weight of drill string 13. The operator then slacks off the tension on drill string 13 above packer 19. Drill string 13 above packer 19 will begin moving downward. Referring to FIG. 2B, mandrel portion 23 moves downward but housing 55 remains stationary as it will be supported by packer 19. The downward movement positions recess 47 adjacent lock member 43, causing lock member 43 to snap into recess 47 as shown in FIG. 3B. In the lower position, shoulder 62 will be resting on shoulder 64 as shown in FIG. 3B.

During this downward movement, mandrel portions 59 and 63 will also move downward. Inner valve sleeve 85 will also move downward as groove 91 will push collet fingers 89 downward. In the lower position, shown in FIG. 3B, inwardly biased collet fingers 49 spring inward, disengaging from threads 53. The operator then picks up the drill string 13. This lifts collet 35 as well as moving inner valve sleeve 85 upward through the connection between collet fingers heads 90 and groove 91. Valve sleeve 85 will move to the closed position shown in FIG. 3D. Collet finger heads 90 will spring out into recess 97, disengaging inner valve sleeve 85 from mandrel lower portion 63.

The operator continues pulling upward, retrieving the portion of drill string 13 located above storm valve 21. Storm valve 21 will be closed with inner valve sleeve 85 and plug 81 blocking any flow up the drill string 13. Mandrel portions 23, 59 and 63 will be retrieved along with the drill string 13 located above storm valve 21.

In the event that fingers 49 fail to disengage from threads 53 due to slacking off weight, the operator may release fingers 49 by rotating drill string 13. Threads 51, 53 are left-hand threads. Right hand rotation causes torque members 50 to rotate fingers 49 relative to upper housing portion 55, unscrewing threads 51 from threads 53. The operator then picks up the drill pipe and sleeve valve 85 will close in the same manner as previously described.

When it is desired to resume drilling, the operator will remove lock member 43 and lower drill pipe 13 with mandrel portions 23, 59 and 63 on the lower end. Collet fingers 49 will stab into upper housing portion 55 adjacent threads 53. Mandrel lower portion 63 contacts finger heads 90, pushing inner sleeve 85 downward to open valve 21. Collet fingers 49 will move downward with mandrel upper portion 23 and engage cam surface 61. The operator rotates drill pipe 13 to the left to screw fingers 49 back into threads 53. The operator releases packer 19 (FIG. 1) and pulls drill string 13, along with storm valve 21. Cam surface 61 prevents threads 51 from disengaging from threads 53.

The invention has significant advantages. The invention allows an operator to store a sting of drill pipe within the cased portion of a hole, rather than pulling the entire drilling string to the surface. Additionally, the invention provides a way to easily close a valve within a drill string.

Although the invention has only been shown in only one of its forms, it should be apparent to those skilled in the art that it is not so limited but is susceptible to various changes without departing from the scope of the invention.

What is claimed is:

1. In a well having a casing, a string of drill pipe extending into the casing, a support mechanism mounted in said string of drill pipe that transfers the weight of the drill pipe below said support mechanism to said casing, an apparatus mounted in said string of drill pipe for opening and closing a passage extending through said drill pipe, said apparatus comprising:

a valve mounted in said passage and movable from an open to a closed position;

an actuator assembly having a logitudinal axis and an upper portion connected to said string of drill pipe above said support member, the actuator assembly located in a first axial position relative to said valve when said valve is in said open position and a second axial position relative to said valve when said valve is in the closed position, said actuator assembly being connected to said valve to close said valve by moving from the first to the second position in response to axial movement of said string of drill pipe above said support mechanism after said drill pipe is supported within said casing by said support mechanism;

a valve connector that connects said actuator assembly to said valve, said valve connector releasing said actuator assembly from said valve upon picking up said string of drill pipe and thus releasing said actuator assembly from the second position, allowing retrieval of said actuator assembly and said string of drill pipe above said support mechanism.

2. The apparatus according to claim 1 wherein said valve comprises:

a housing secured to said string of drill pipe, an outer valve sleeve within said housing;

an inner valve sleeve carried concentrically within said outer valve sleeve, each of said sleeves having an aperture, one of the sleeves being stationarily mounted to the housing and the other to the actuator assembly by the valve connector; and wherein said apertures align while the valve is moved to the open position.

3. The apparatus according to claim 1 wherein:

wherein said apertures align while said valve is in said open position; and wherein said actuator assembly is moved upward when moving from said first to said second position.

4. The apparatus according to claim 1 wherein:

said valve connector comprises a plurality of fingers extending upward from said valve that have engaged and disengaged positions with said actuator assembly, said fingers being radially movable relative to said axis of said actuator assembly from the engaged to the disengaged position while said actuator assembly is in said second position.

5. The apparatus according to claim 1 wherein:

said upper position of said actuator assembly is connected to said string of drill pipe above said support mechanism for rotational and axial movement therewith.

6. The apparatus according to claim 1 wherein said valve comprises:

a housing having a lower end connected to said string of drill pipe;

a sleeve that is axially movable relative to said housing from an open to a closed position;

a flowby passage that has a lower end communicating with said drill pipe passage;

said sleeve having a port that registers with said flowby passage to allow flow through said flowby passage when said sleeve is in the open position; and wherein said valve connector comprises a plurality of fingers extending upward from said sleeve that have engaged and disengaged positions with said actuator assembly, said fingers being radially movable relative to said axis of said actuator assembly from said engaged to said disengaged position while said actuator assembly is picked upward from said second position.

7. The apparatus according to claim 6 wherein said actuator assembly comprises:

a mandrel having an upper end mounted to said string of drill pipe and having a lower end that is engaged by said finger of said valve connector;

an upper collet, with lower fingers that engage said housing, said upper collet being secured to said mandrel such that lowering said actuator assembly and thus said mandrel from said first position disengages said lower fingers from said housing.

8. The application according to claim 1 wherein:

a torque transmitter mounted between said actuator assembly and a portion of said valve, the torque transmitter transfering torque imposed on said actuator assembly by rotation of said drill pipe to the portion of said string of drill pipe located below said actuator assembly, while said valve is in said open position, said torque transmitter being releasable in response to picking up said actuator assembly from said second position.

9. In a well having a casing, a string of drill pipe extending into the casing, a support mechanism mounted in said string of drill pipe that when set transfers the weight of the drill pipe below said support mechanism to said casing, an apparatus mounted in said string of drill pipe for opening and closing a passage extending through said drill pipe, said apparatus comprising:

a housing having a lower end secured to said string of drill pipe;

a mandrel positioned within said housing and having an upper end secured to said string of drill pipe;

a valve sleeve in said housing movable from an open to a closed position by moving said valve sleeve upward relative to said housing;

an upper connector that releasably connects said mandrel to said housing and disconnects said mandrel from said housing in response to downward movement of said mandrel relative to said housing;

a lower connector that releasably connects said mandrel to said valve sleeve and disconnects said mandrel from said valve sleeve in response to upward movement of said mandrel relative to said housing after said valve sleeve is in said closed position;

wherein slacking off tension on said drill string after said support mechanism has set moves said mandrel and said sleeve downward relative to said housing and causes said upper connecter to disconnect said mandrel from said housing; and wherein picking up said drill string after said mechanism is disconnected from said housing pulls said valve sleeve up to a closed position and said lower connector disconnects said mandrel from said valve sleeve.

10. The well according to claim 9 wherein said upper connector comprises:

a collet member surrounding said mandrel and having a lock member on an upper end for selectively engaging an external recess on said mandrel, said collet member having inwardly biased depending fingers on a lower end of said collet member;

said upper end of said housing having an internal groove that is engaged by said fingers on said collet member prior to moving said mandrel downward;

said mandrel having an external conical cam surface engaging said fingers of said collet member for forcing said fingers outward to force engagement with said groove in said housing prior to said mandrel being moved downward; wherein, slacking off tension in said string of drill pipe after said support mechanism has set causes said collet member to disengage said housing.

11. The well according to claim 10 further comprising:

a means for rotating said collet fingers with respect to said upper housing portion for unscrewing said collet fingers from said upper housing portion.

12. The well according to claim 10 wherein said upper end of said collet member has lock member that is inwardly biased by a spring that snaps said lock member into a lock recess or said mandrel upon alignment of said lock member and said lock recess.

13. The well according to claim 9 wherein said lower connector comprises:

outwardly biased collet fingers extending upward from said valve sleeve, each of said collet fingers having a head on an upper end;

an annular groove in said mandrel for receiving said heads on said outwardly biased collet fingers, wherein said heads are maintained in said groove engaged with and an inner diameter of said housing;

a recess in said inner diameter of said housing is positioned so that when said mandrel is raised, said heads on said upper ends of said outwardly biased collet fingers spring outward into said recess and out of engagement with said annular groove, thereby releasing said valve sleeve from engagement with said mandrel.

14. In a well having a casing, an apparatus for suspending a string of drill pipe within said casing comprising:

a packer mounted in said string of drill pipe and settable in an annulus between said drill pipe and said casing, said packer having a hanger mechanism for supporting said drill pipe in the well;

a mandrel upper portion secured to said string of drill pipe and defining an interior passage, said mandrel upper portion having a lower end and an external recess;

a collet member surrounding said mandrel upper portion, said mandrel upper portion being downwardly movable a short distance relative to said collet member, placing said collet member in a released position;

a lock member on an upper end of said collet member for engaging said external recess of said mandrel upper portion while said collet member is in the released position to lock said collet member in said upper position, said collet member having inwardly biased depending fingers on a lower end of said collet member;

a housing secured to said string of drill pipe having an upper end with an internal groove for engaging said inwardly biased depending fingers on said collet member;

a mandrel intermediate portion having an external conical cam surface on an upper end of said mandrel intermediate portion for forcing said inwardly biased depending fingers of said collet member outward to force engagement with said groove in said housing;

said mandrel portions being movable downwardly relative to said housing in response to slacking off tension in said string of drill pipe after said packer is set causing the collet member to move to said released position and to disengage said housing;

an inner valve sleeve located in the housing, having outwardly biased collet fingers on an upper end of said inner valve sleeve and having a flow port passing therethrough, each of said outwardly biased collet fingers having a head on an upper end;

a mandrel lower portion affixed to a lower end of said mandrel intermediate portion and having an annular groove in a lower end of said mandrel lower portion for receiving said heads on said upper ends of said outwardly biased collet fingers of said inner valve sleeve; and an outer valve sleeve stationarily mounted in said housing and surrounding said inner valve sleeve, said inner valve sleeve being movable upward with said mandrel portions to an upper position relative to said outer valve sleeve, and said outer valve sleeve having a flow port that selectively communicates with said flow port of said inner valve sleeve when said inner valve sleeve is in a lower position but not in said closed position, said heads on said outward biased collet fingers disengaging from said annular groove when said outer valve sleeve is in said upper position, allowing said mandrel lower portion to be retrieved.

15. The apparatus according to claim 14, wherein:

said inwardly biased fingers on said collet member have external threads and said housing internal groove comprises a mating set of threads.

16. The apparatus according to claim 14, wherein:

said mandrel upper portion has a torque key affixed proximate a lower end of said mandrel upper portion that extend between said inwardly biased depending fingers of said collet member for applying rotational force to said collet member when said mandrel upper portion is rotated to unscrew said collet member from said housing in the event said fingers do not release from said threads, thereby enabling said drill string, said mandrel upper portion, said mandrel intermediate portion, and said mandrel lower portion to be removed from the well.

17. The apparatus according to claim 14, wherein:

a pin affixed to said collet member engages said mandrel upper portion to transmit torque from said mandrel upper portion to a housing to set a packer.

18. A method of temporarily storing a string of drill pipe in a well that has a cased portion, the method comprising the steps of:

(a) mounting a valve in said string of drill pipe, and an actuator assembly that moves with respect to axial movement of the drill pipe to close said valve;

(b) mounting a packer around said string of drill pipe below said valve;

(c) positioning the string of drill pipe within the cased portion of the well, then setting the packer to support said string of drill pipe; then (d) moving the drill string in straight axial movement to move the actuator to close the valve, and disengaging said actuator assembly from said valve; and (e) retrieving said drill pipe above said packer and said actuator assembly.

19. The method according to claim 18 wherein step (d) comprises:

slacking tension in said drill string above said packer to cause said drill string above said packer and said actuator assembly to move downward, then picking up said drill string.

* * * * *